US006921060B2

(12) United States Patent
Weed, Jr.

(10) Patent No.: US 6,921,060 B2
(45) Date of Patent: Jul. 26, 2005

(54) WINCH HANDLE

(75) Inventor: Ronald Thomas Weed, Jr., 207 Doncaster Rd., Arnold, MD (US) 21012

(73) Assignee: Ronald Thomas Weed, Jr., Arnold, MD (US)

( * ) Notice: Subject to any disclaimer, the term of this patent is extended or adjusted under 35 U.S.C. 154(b) by 0 days.

(21) Appl. No.: 10/460,522

(22) Filed: Jun. 12, 2003

(65) Prior Publication Data

US 2004/0251454 A1 Dec. 16, 2004

(51) Int. Cl.[7] ..... B66D 1/00
(52) U.S. Cl. ..... 254/266; 74/546; 74/547
(58) Field of Search ..... 254/266; 74/545–547

(56) References Cited

U.S. PATENT DOCUMENTS

| | | | | |
|---|---|---|---|---|
| 1,247,911 A | | 11/1917 | Walkup | |
| 1,348,193 A | * | 8/1920 | Wenderhold | 74/547 |
| 1,424,045 A | * | 7/1922 | Sprague | 74/546 |
| 2,455,819 A | | 12/1948 | Smith | |
| 3,536,299 A | | 10/1970 | McCoud et al. | |
| 4,018,035 A | | 4/1977 | Morrison | |
| 4,057,218 A | | 11/1977 | Wallace | |
| 4,391,432 A | | 7/1983 | Baud | |
| 4,531,715 A | | 7/1985 | Wiens | |
| D336,233 S | | 6/1993 | Zimmermann | |
| 5,509,327 A | | 4/1996 | Cropley | |
| 5,802,673 A | * | 9/1998 | Nemeth | 16/429 |
| 5,833,217 A | | 11/1998 | Goldsby | |
| 6,112,617 A | | 9/2000 | Abrams et al. | |

FOREIGN PATENT DOCUMENTS

| | | |
|---|---|---|
| CH | 664936 A5 | 12/1978 |
| FR | 2 802 909 | 12/1999 |
| GB | 1 432 957 | 4/1976 |

* cited by examiner

*Primary Examiner*—Emmanuel Marcelo
(74) *Attorney, Agent, or Firm*—Husch & Eppenberger, LLC; Robert C. Haldiman

(57) ABSTRACT

A winch handle for a winch has an extendable arm with an extended position and a retracted position. The retracted position of said extendable arm being equal to or within the diameter of the winch. In its retracted position, the extendable arm is shaped in a fashion that does not interfere with the operation of the winch while the handle is not needed. The extended position of the extendable arm is longer than the diameter of the standard winch and is useful for turning the winch. The winch handle may also have a grip.

9 Claims, 11 Drawing Sheets

WINCH HANDLE

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The invention is in the field of winch handles, especially winch handles for sail boats.

2. Related Art

From ancient times sailors concerns have included the secure stowage of equipment and also quick a secure adjustment of ropes ("lines") on winches, capstans, cleats and the like. Modern sailboats have augmented the ease with which a sailor can adjust lines, stays or halyards by incorporating winches into the rigging. Sail line winches, like other winches, use internal gearing to magnify the manual power a sailor needs to apply to the winch drum for taking in a line bearing a load. Such winches include a drum and a handle. One end of the rotatable drum is attached to the deck. At the other end of the drum is a handle which the sailor uses to manually turn the winch. The handle may be permanently attached or, more often, removable.

In order to have leverage, a winch handle must necessarily be longer than the diameter of the winch it is turning. However, the presence of a long winch handle on the winch interferes with the use of the winch in that the line can become tangled in the handle when the line is being taken in, taken out or otherwise adjusted. The problem is exacerbated when the line is under load. An initial winding on of the line would require the line to be taken around the outside of the length of the handle. Pay out of the line under tension, if tangled in the handle, can lead to failure to execute necessary maneuvers. There can even be a safety issue if a winch is released to spin while a handle is still on it.

The prior art has endeavored to address these problems with removable handles. With the handle off, a winch with line on it can be taken in, let out, have the line slipped off of the winch in an axial direction, or otherwise be put to use without interference or tangling in a handle. However, removable handles create a different problem in that it may not be convenient to stow them when not in use. Loose handles on the deck, or even in storage slots or spaces provided for them, are more prone to loss, safety problems or difficulty of access when needed. There is a need in the art for a winch handle that remains attached to the winch, but is nevertheless removable to a position that does not interfere with uses of the winch that do not require the handle.

Several prior art attempts to deal with these problems involve a winch handle that recesses into an axial sleeve in a non-standard winch. See, U.S. Pat. No. 3,536,299 to McCloud et al.; U.S. Pat. No. 4,391,432 to Baud; and U.S. Pat. No. 4,531,715 to Weins, for example. Chief among the insufficiencies of these prior art winches is that they require a through hole in the deck of the sailboat in order to allow sufficient room for the stowed winch handle to recess. Unnecessary through holes in deck and hull are always discouraged in nautical design.

There remains a need in the art for a winch with an attached handle that stows in a manner sufficiently compact that it allows quick and efficient interaction between the winch and a line when the winch is put to uses that do not require the handle. Moreover, since there are in use today many winches having sockets for receiving removable handles, there is a need in the art for a retro-fittable winch attachment that incorporates a cleanly stowable, attached winch handle into the preexisting winch.

SUMMARY OF THE INVENTION

The present invention is a stowable winch handle for a sailboat winch that remains attached to the winch when not in use. The handle is comprised of a retractable arm that may be permanently attached to the winch, or may engage a socket in the winch with a stud adapted to insert into the socket. The retractable arm has an extended position and a retracted position. When extended, the arm is used as a handle to turn the winch. When retracted, the arm remains attached to the winch, but is short enough and shaped in a fashion not to interfere with other uses of the winch.

The invention may also be comprised of a cowl attached to a winch. The cowl has a diameter substantially coextensive with the diameter of the winch. A cowl is attached to the top of the winch drum, which is the end opposite the deck. The cowl may have parallel sides, or may be in the shape of a truncated cone or otherwise flared. The cowl may be any shape, provided that its interaction with the winch drum allows the winch drum to be used to hold and manipulate the line without catching in the cowl or retracted handle. Alternatively, a smooth interface between the handle and/or the cowl and the outer face of the drum may be achieved with the use of a shroud as an adapter.

Within the cowl are the retractable arm and a hinged grip. The retractable arm has a first end and a second end. The first end is attached to the cowl and winch such that it can rotate the winch when a manual force is applied to it. The second end of the arm holds the grip, which is attached to the second end of the arm, as by a hinge.

To stow the winch handle, the grip is folded downward to a position that is substantially parallel and adjacent to the retractable arm and the retractable arm is moved into a compacted position, for example by telescoping action. In this position the dimensions of the arm and grip are substantially coextensive with a diameter of the cowl, or a flange on top of the winch. The stowed position is sufficient to allow line to be drawn onto or taken off of the winch drum over the cowl without interference from the stowed winch handle. In its extended position, the grip and arm serve as a handle for turning the winch.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Referring to the accompanying drawings in which like reference numbers indicate like elements, FIGS. 1A, 1B, 1C, 1D, 1E are schematic perspective views of the winch handle 10 of the present invention. The winch handle 10 is comprised of a cowl 12. In the depicted embodiment, the cowl is fixedly attached to a winch stud adapter 14. The cowl will serve as a housing over which line may be passed, under tension or not, without catching or other interference with the further constituent components of the winch handle 10.

The winch handle of the present invention may be permanently fixed to a winch drum by integral molding, forging or otherwise known means of fabrication or attachment. In the depicted embodiment, however, a removable winch handle 10 may be adapted to fit on any of a variety of standard nautical winches already known. The vast majority of those winches in common use, as for example those manufactured by Harken™, Lewmar™ or Baraent™ have standard prior art removable handles. The removable handles have a stud that seats in a axial sleeve for use in turning the winch. The winch stud adapter 14 in the depicted embodiment is also adapted to fit into the axial sleeve of standard winches such that the winch handle of the present invention may also engage and drive them.

Figure 7:
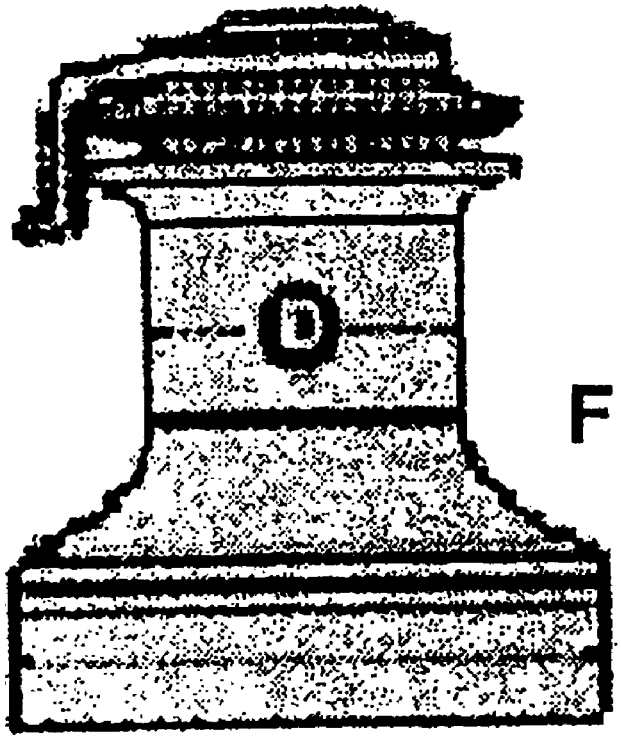
FIG. 7 is a standard winch with a self tailing device.
Figure 6:
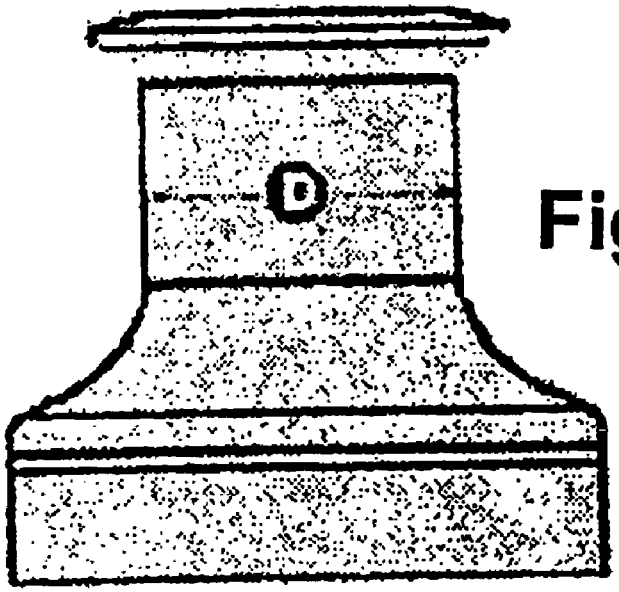
Fig. 6 PRIOR ART
FIG. 6 is a standard winch.

A standard winch as used herein means a winch with a socket for receiving a removable winch handle such as those made by the manufactures listed above. A standard winch will be understood to exclude winches with axial recesses for stowing a permanent handle, such as those disclosed in U.S. Pat. Nos. 3,536,299; 4,391,432 and 4,531,715, see above. A standard winch may mean a winch such as that depicted in FIG. 6, as well as a "self tailing" winch such as depicted in FIG. 7.

A cowl 12 is attached to extension arm 20. Arm 20 is comprised of an inner component 22, which is attached to and recessed within cowl 12. Telescoping from first component 22 are slidingly attached and concentric arm sections 24, 26 and 28.

At an outer end of outermost telescoping arm segment 28 a grip 30 may be added. The grip 30 may be attached with a hinge 32. Alternatively, the grip may be permanently fixed in a position perpendicular to the arm, as by integral forging, or may be attached by any known means.

Figure 1:
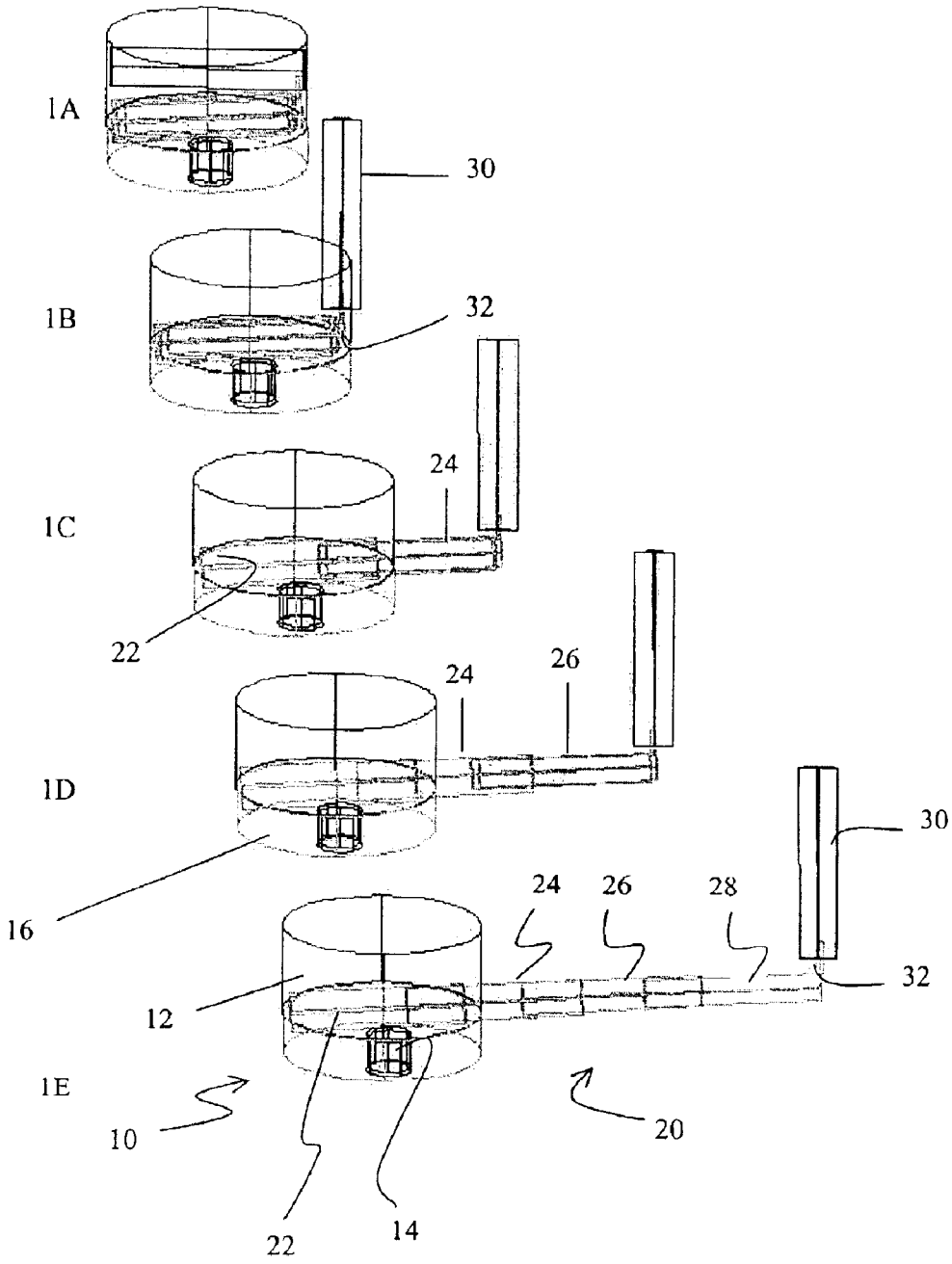
FIG. 1A is a schematic perspective view of the winch handle in a stowed position.
FIG. 1B is a schematic perspective view of the winch handle with its grip deployed while the arm remains stowed.
FIG. 1C is a schematic perspective view of the winch handle with the arm in a first extended position.
FIG. 1D is a schematic perspective view of the winch handle with the arm in a second extended position.
FIG. 1E is a schematic perspective view of the winch handle in the fully extended position.

In FIG. 1A extending arm 20 and grip 30 are retracted and stowed. As is evident, substantially the entire dimensions of arm 20 and grip 30 are within the diameter of cowl 12. The winch handle 10 is attached via winch stud adapter 14 to a winch drum. The outer cowl dimension is substantially flush with the outer winch drum dimension (which is a flange on standard winches) and, when stowed, so are the arm 20 and grip 30. Accordingly, line from a winch drum may move over the cowl 12 without catching on or otherwise being interfered with by the arm 20 or handle 30. Thereby, a sailor may wrap, unwrap, release or otherwise adjust the line on the drum, whether the line is under load or not, without any interference from a winch handle.

To further promote smooth play of line over the winch flange and cowl, a shroud 16 may alternatively be included. It may be a permanent attachment to the bottom of the cowl 12. It may be a removable or adjustable attachment to the bottom of the cowl 12. The shroud 16 may be of a malleable or flexible material, for example rubber. In any case, the shroud 16 serves to fill any gap between the bottom of the cowl 12 or extending arm 20 and the top or flange of the winch. Any gap, if wide enough, may catch a line wound on the winch and interfere with coiling, releasing or adjusting the line. The shroud 16 prevents such interference.

In FIG. 1B a first step of deployment for use is depicted. Grip 30 is rotated upwards on hinge 32. In FIG. 1C a first moveable arm segment 24 is extended from fixed segment 22. In FIG. 1D a second arm segment 26 is telescoped from a first moveable arm segment 24. In FIG. 1E a last telescoping arm segment 28 is telescoped from second moving arm segment 26, so that all segments 24, 26 and 28 of extending arm 20 are fully extended. In this position the winch handle 10 is in a position to give maximum leverage to a sailor manually winding tensioned line onto attached winch drum by holding grip 30 and turning the entire assembly.

FIGS. 2A, 2B, 2C, 2D and 2E depict the same positions of the winch handle 10 when the winch handle 10 is attached to a standard winch 40. As is apparent, winch 40 has a boat deck end 42 a drum cylinder 44 and an outer flange 46. In the depicted embodiment, the outer dimension of the cowl 12 is substantially coextensive with the outer dimension of the winch flange 46. Alternatively, the cowl may be somewhat narrower in dimension than the winch flange 46. Another alternative cowl may have a truncated cone shape, or a flared shape with curving sides. Provided that the base of the cowl oriented towards the winch is equal to or narrower than the diameter of the winch flange 46, the outer face 13 of the cowl 12 may be any size, shape or dimension including less than but preferably equal to or greater than the dimension of the interface 11, provided that the dimension allows for a smooth and interference free movement of line over cowling 12 and onto or off from winch drum cylinder 44, whether the line is under tension or not. A flanged cowl design may be desirable for creating extra space for the stowage of the extending arm 20 and grip 30. Alternatively, the cowling may include a self-tailing finger (FIG. 7) that is fabricated or integrated formed with the cowling.

The interface between arm 20 and cowling 12 may be supplemented by a snap fit to strengthen the assembly in the extended position. Likewise, both arm 20 and grip 30 may be received into snap fits in the cowl 12 in the stowed, collapsed position, in order to hold them in place.

In alternative embodiments, a telescoping arm 20 may have a cross section of any shape, including without limitation circular, elliptical, flat, rectangular or otherwise. The grip 30 may hinge from a substantially flat position to a substantially perpendicular position relative to extending arm 20 in an upwards direction, or, alternatively, in a downwards direction, towards the deck. In the alternative downward embodiment, a space would need to be provided within cowling 12 for receiving grip into a stowed position beneath extending arm 20, that is, closer to the deck than extending arm 20. In a further alternative embodiment, grip 30 may itself telescope (not shown) such that its vertical dimension in a deployed position may be extended.

It is considered to be within the scope of the present invention that the arm may extend by any means, including without limitation the depicted telescoping arm, other sliding arms, a hinging arm as disclosed below, or other hinging arms. The engagement between arm sections may be by sliding, snap fits, hinges or other means. Any handle that retracts to a dimension flush with a winch drum or its flange, without requiring any recess or receiving structure in the winch is considered to be within the scope of the present invention. The extending arm, especially a telescoping arm may have an internal spring to bias movement in aid of retraction, extension, or midpoint or rest position between the two, i.e., "half-way out."

Figure 2:
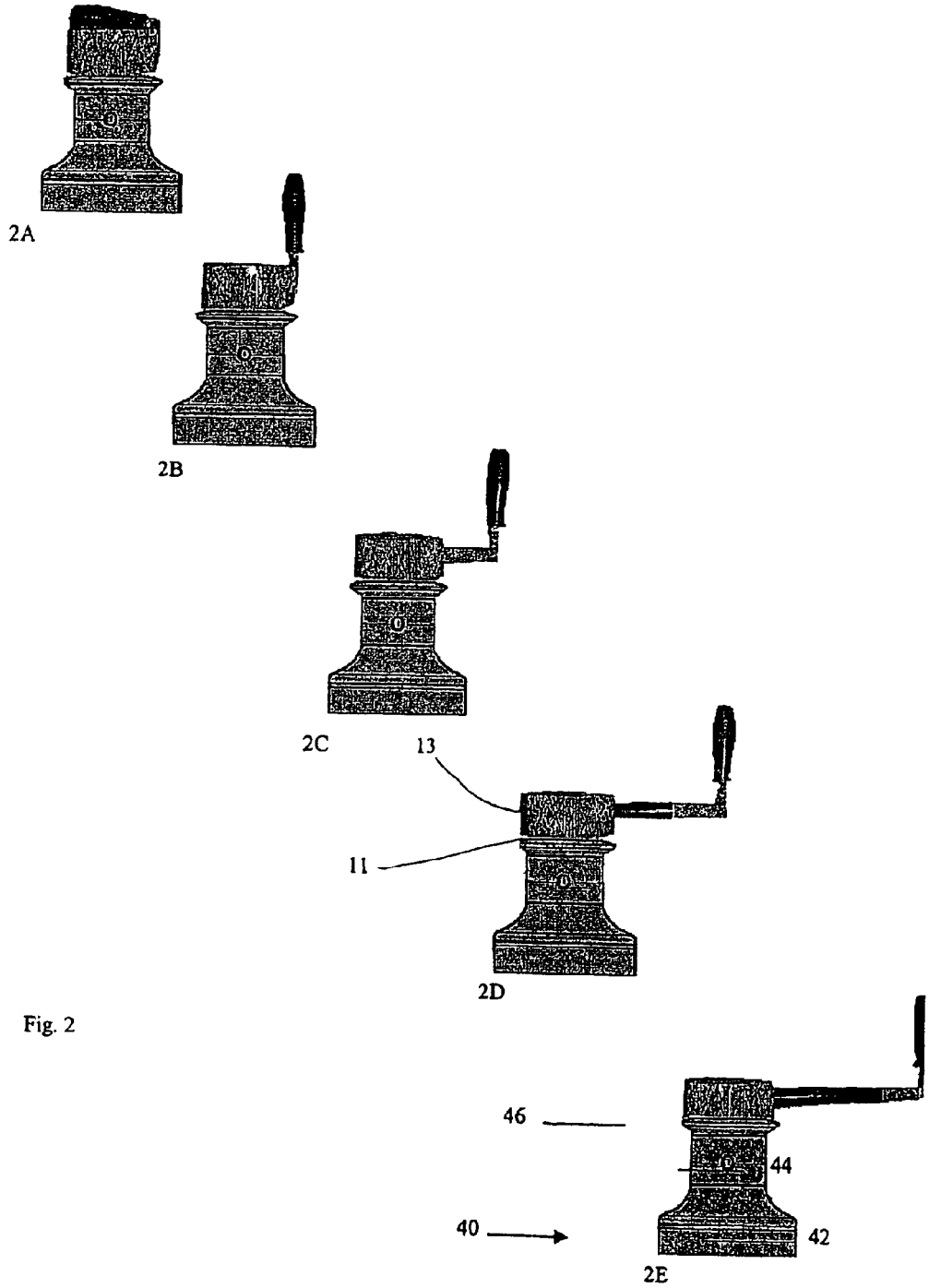
FIG. 2A is a side view of the winch handle in a stowed position.
FIG. 2B is a side view of the winch handle with its grip deployed while the arm remains stowed.
FIG. 2C is a side view of the winch handle with the arm in a first extended position.
FIG. 2D is a side view of the winch handle with the arm in a second extended position.
FIG. 2E is a side view of the winch handle in the fully extended position.
Figure 3:
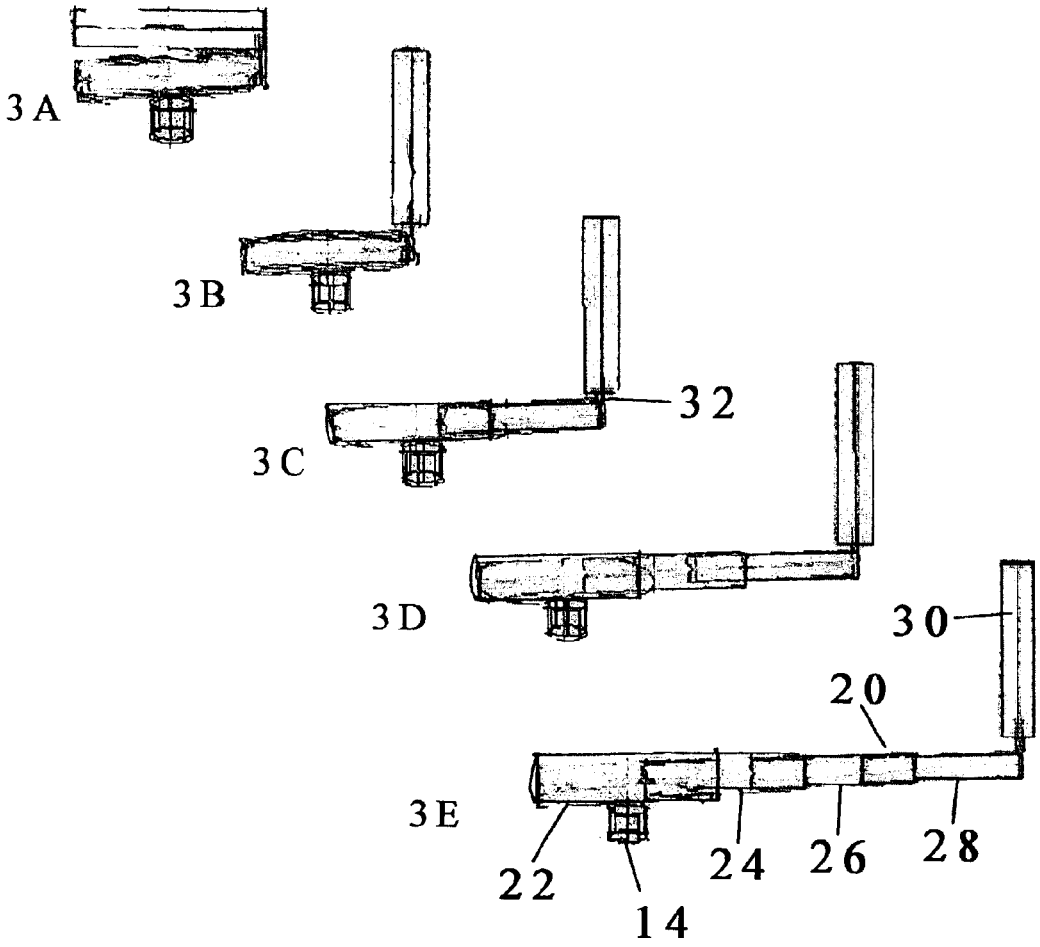
FIG. 3A is a schematic side view of the winch handle in a stowed position, without the cowl.
FIG. 3B is a schematic side view of the winch handle its grip deployed while the arm remains stowed, without the cowl.
FIG. 3C is a schematic side view of the winch handle with the arm in a first extended position, without the cowl.
FIG. 3D is a schematic side view of the winch handle with the arm in a second extended position, without the cowl.
FIG. 3E is a schematic side view of the winch handle in the fully extended position, without the cowl.

It will be apparent to those skilled in the art that the winch handle of the present invention may be manufactured in conjunction with or retrofitted to winch flange 46 on either a standard winch such as that depicted in FIG. 2 or also other types of winches, for example self tailing winches. In the case of a self tailing winch, the self tailing cams and their mounting arm may be disposed between the cowl 12 and the winch 40.

FIGS. 3A through 3E illustrate that the winch handle of the present invention may be fabricated and used without the presence of a cowl or shroud. The telescoping arm 20 remains comprised of interlocking segments 22, 24, 26 and 28. Segment 28 terminates in hinge 32 for attachment of folding grip 30. Innermost telescoping arm segment 22 remains fixedly attached to stud adapter 14. Like the embodiments with the cowl and/or shroud, the winch handle of the embodiment depicted in FIG. 3 collapses into a stowed position that is substantially equivalent to or less than the diameter of the outer flange 46 of the winch 40.

Figure 4A:
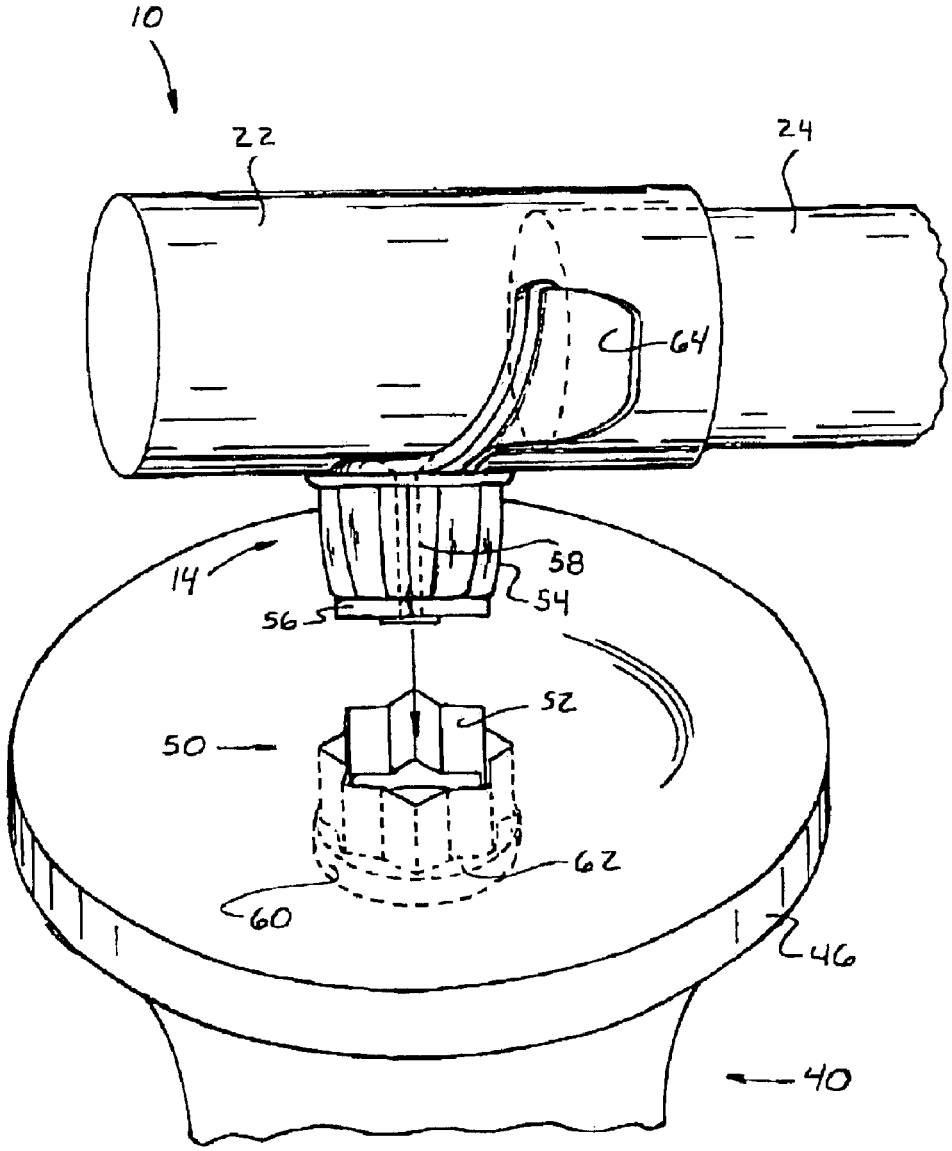
FIG. 4A is a perspective, cutaway close up of the interaction of the locking stud with the winch.
Figure 4B:
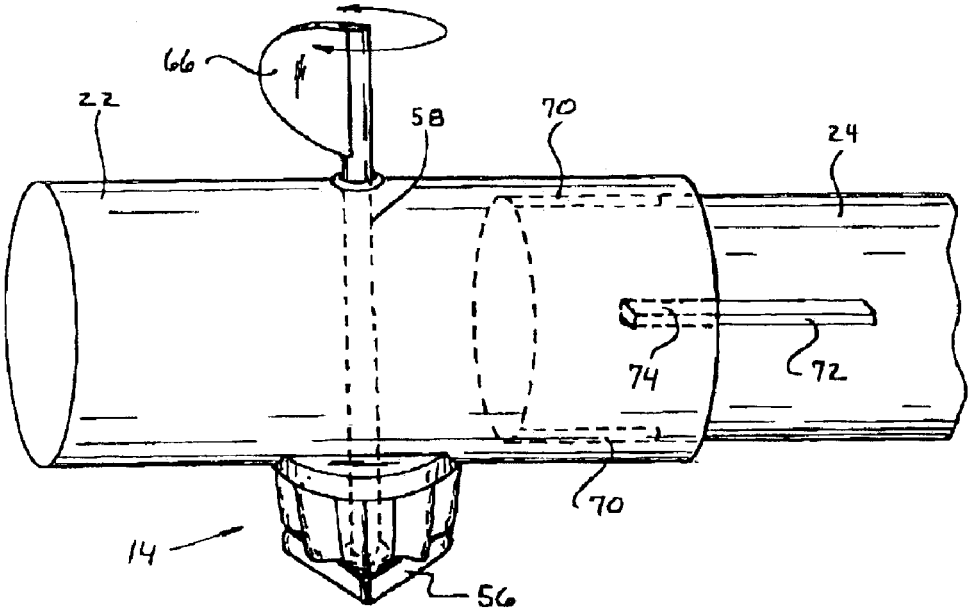
FIG. 4B is a perspective cutaway close up of an alternative locking stud toggle.

FIG. 4 depicts the interaction of the adapter stud 14 with winch 40. The locking feature described and depicted in FIG. 4 is a desirable feature for an embodiment of the winch handle that is separate from the winch. It may be used with any of a wide variety of preexisting winches.

Adapter stud 14 is configured to interlock with receiving female component 50 of winch 40. The shape of the interlocking faces 52 of the female component 50 and faces 54 of the adapter stud male component 14 is arbitrary, provided that they allow for rotational force applied to the winch handle to rotate the winch. One commonly preexisting configuration is that both the adapter stud faces 54 and female socket faces 52 are octagonal. The depicted locking mechanism may be incorporated with the winch handle of the present invention. The locking mechanism includes a square lock 56 which is fixedly and rotatably attached to the adapter stud 14 via an internal screw or rod 58. Rotatable locking square 56 has a position in which its protruding corners are co-terminus with protruding corners of faces 54 of adapter stud 14. In this position both the adapter stud 14 and locking square 56 may be inserted into female socket 50. The adapter stud 14 and its locking square 56 are longer than the depth of female socket 50 in a dimension sufficient to allow the locking square 56 to be inserted to the level of a wider internal dimension 60 within winch 40. When so installed, locking square 56 is free to rotate within space 60 of winch 40. Locking may thereafter be achieved by rotating square 56 so that its corners are out of alignment with the corners of faces 54 of adapter stud 14, and therefore also correspondingly out of alignment with the faces 52 of female socket 50. In this locked position an outwards axial force on the winch handle will be blocked by the contact of the corners of locking square 56 with the upper face of internal space 60 of winch 40.

The present invention may have a male stud or a female socket adapted to engage one standard winches with male stud, or standard winches with a separate two way converted stud.

In order to incorporate this locking feature with the winch handle of the present invention, locking stud 14 is fixedly attached to the exterior of internal arm segment 22. This attachment may be by forging, welding, bonding, bolting, screwing or any other known means of fixation. The pin or screw 58 is fixedly attached to a lever or toggle 64. Toggle or lever 64 (or 66 in FIG. 4B) may be removable, like a key or tool that is not permanently attached. Removeability allows the user to leave handle attached while boat is idle at dock, making vandalism or theft difficult without specific the key or tool. Removeability may be by any known means, as indicated schematically in areas 68 in FIGS. 4A and 4B. Manually turning toggle 64 turns pin 58 and locking square 56 so that locking square 56 may be rotated from its insertable position to its locking position. In the embodiment depicted in FIG. 4 toggle or lever 64 proceeds laterally outwards through an opening in the fixation of adapter stud 14 to arm segment 22. In this configuration, the toggle or lever will not interfere with the telescoping recess of other arm segments 24, 26 or 28 into their compacted position within first arm segment 22.

In the alternative embodiment depicted in FIG. 4, pin 58 may extend entirely vertically through inner arm segment 22 so that a toggle or lever 66 may appear on top of the arm segment 22. This embodiment, in order to allow the next telescoping arm segment 24, as well as the further segments 26 and 28, to telescope into first segment 22 and avoid the pin 58 extending therethrough, slots 70 at the top and the bottom of telescoping arm 24, 26 and 28 are fabricated in them. In order to ensure proper alignment of the telescoping arm slots 70 with a pin 58, a guide rail 72 is fabricated into telescoping arms 24, 26 and 28. The guide rail 72 is received by the antirotation groove 74 in close sliding cooperation with it. Either of the depicted embodiments of a toggle or lever will provide quick manual access to the toggle or lever in order that a sailor may quickly and easily lock the winch handle into the winch and unlock it for removal.

Figure 5A:
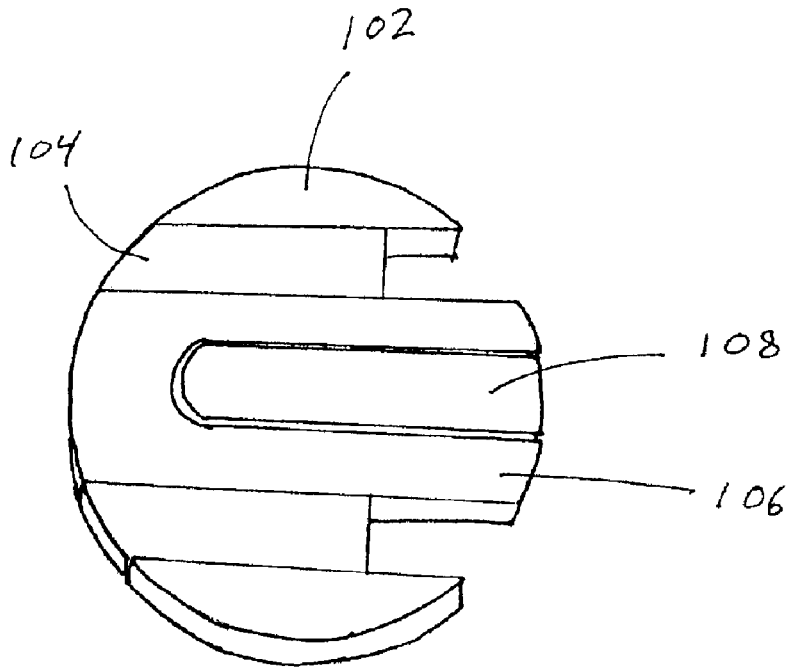
FIG. 5A is an alternative embodiment of the winch handle in a first position.
Figure 5B:
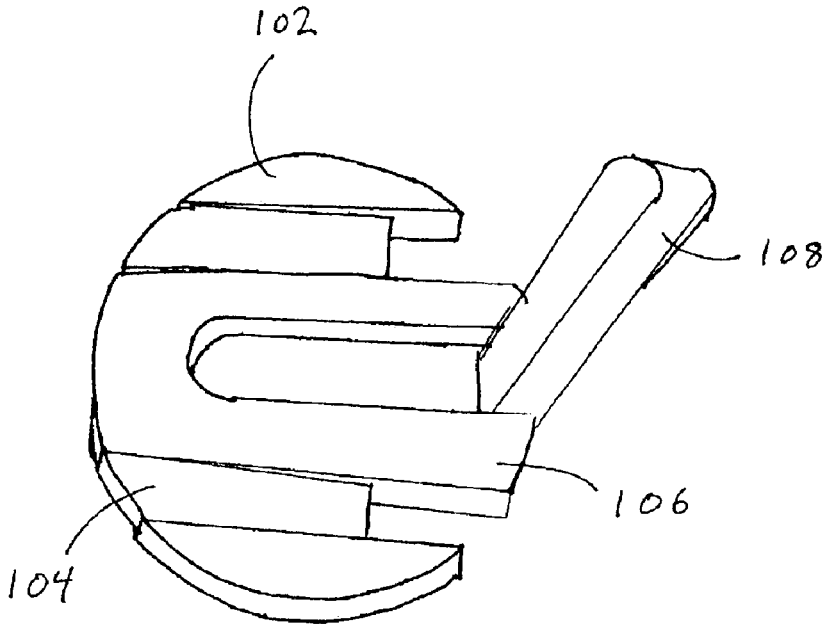
FIG. 5B is an alternative embodiment of the winch handle in a second position.
Figure 5C:
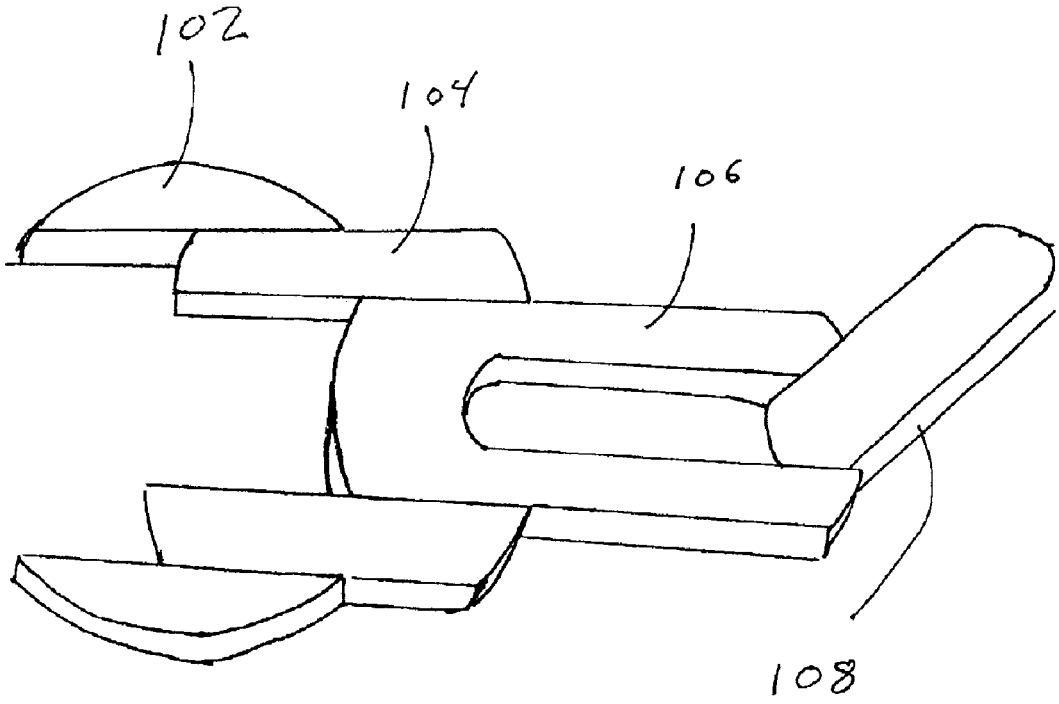
FIG. 5C is an alternative embodiment of the winch handle in a fully extended position.

FIGS. 5A, 5B and 5C depict an alternative embodiment of a winch handle according to the principle of the present invention. FIG. 5A shows the winch handle in a compressed position for stowage. FIG. 5C shows it in a fully extended position and FIG. 5B shows it in an intermediate position. In this embodiment the stowable winch handle is comprised of outer anchors 102, extension arms 104, bracket 106, and grip 108. Grip 108 is hingedly attached to bracket 106. Bracket 106 is, at its opposite end, hingely attached to each of two lever arms 104. Lever arms 104 are, at their opposite end, hingedly attached to anchors 102. As can be seen in the illustrations, lever arms 104 swing at their hinge up and away from anchors 102 and outwards into an extended position beyond the diameter of anchors 102. Bracket 106 similarly hinges away from extending arms 104 to a position farther removed from the winch. Finally, grip 108 extends from bracket 106 to a dimension even farther removed from the winch. Thereafter, grip 108 may be conveniently grasped by the sailor in order to turn it and, thereby turn the attached winch.

Anchors 102 may be fixedly attached to a winch in a permanent configuration. Alternatively, anchors 102 may be attached to a preexisting winch by any of a variety of known techniques, as for example, a snap fit. It is apparent from FIG. 5A that the stowed position of this alternative embodiment winch handle is compact and may be configured to be substantially coextensive with the outer diameter of a winch. Thereby this second depicted embodiment provides the advantages of a winch handle attached to the winch that does not interfere with the line on the winch.

Figure 8:
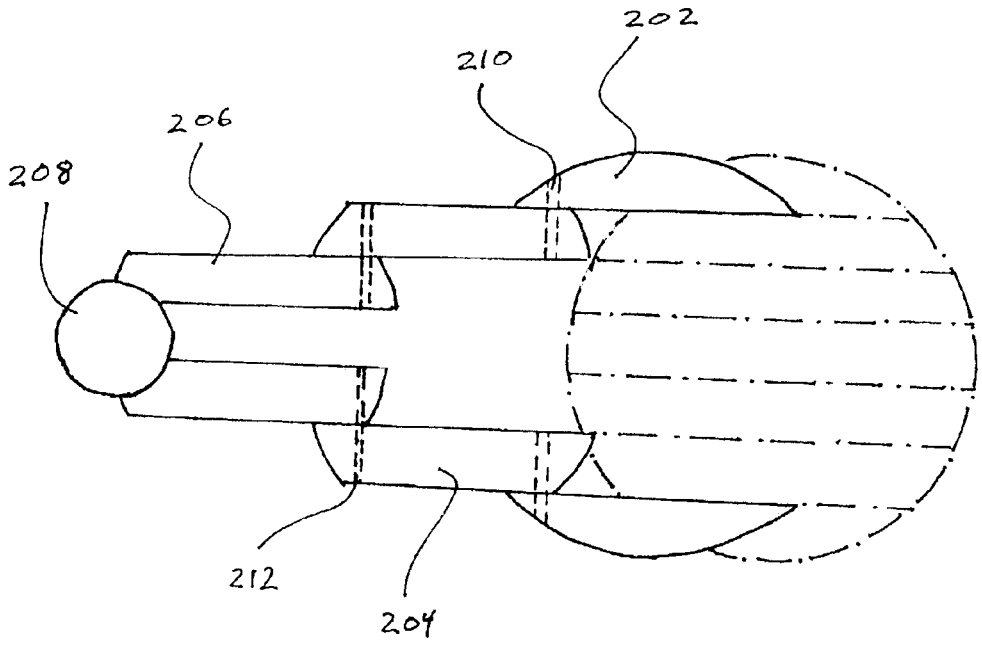
FIG. 8 is a top view of an alternative sliding embodiment.
Figure 9:
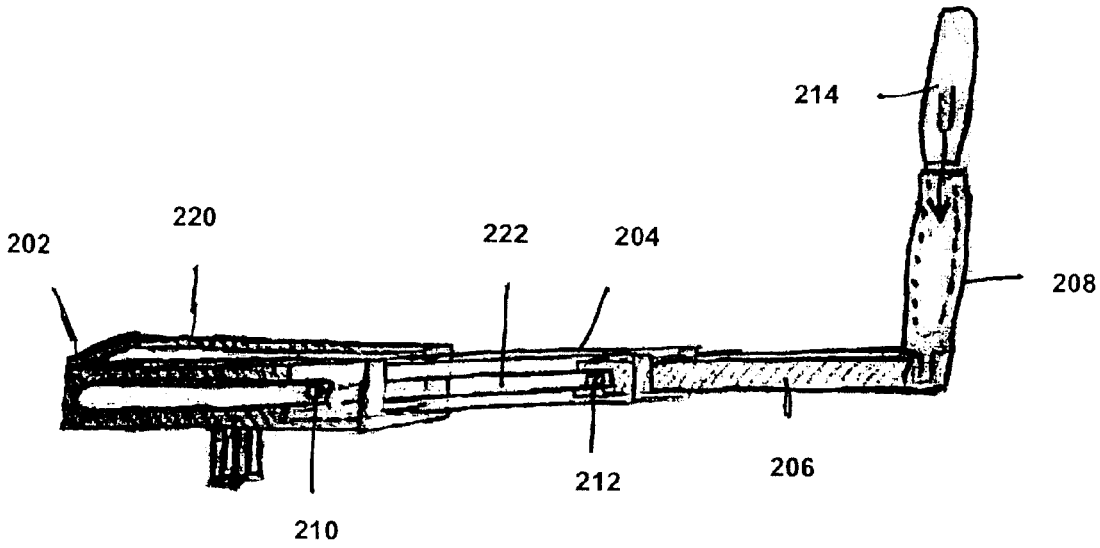
FIG. 9 is a perspective view of an alternative sliding embodiment.

FIGS. 8 and 9 depict another embodiment of the present invention. These embodiments depict an extendable arm that slides, but is not telescopic. In both cases pins 210 and 212 slide in slots 220 and 222.

In FIG. 8 the cylindrical silhouette is used for the stowed position. When extended for use, the handle 208 is pulled in a radial direction. Through its connection, preferably hinged, with the outer most section of the extending arm 206, 206 is slide relative to middle section 204 in a radial direction. Pins 212 fixedly attached to either outer extension 206 or intermediate extension 204 slide in slots or channels which may be fabricated into the other outer section or intermediate section 206 and 204. In a similar fashion, pin 210 and a slot or channel (not depicted in FIG. 8) mediate the travel of intermediate section 204 with base section 202. Base section 202 is attached to the outer flange of a wench (not show in FIG. 8). Alternatively, the fixation of base section 202 may also move relative to the winch by means of a slide with a similar, axillary orientated pin and channel arrangement (not shown) or any other known sliding fixation means that provides for base section 202 to be substantially centered over the winch and substantially co-extensive with the winch circumference when in its stowed position. Similarly, when stowed intermediate section 204 and outer extension 206, as can be seen in FIG. 8, stow into a circular or disk shape that is substantially coextensive with the dimensions of the winch outer flange as indicated by the broken lines in FIG. 8.

FIG. 9 is another embodiment of a sliding version of the present invention. In this case, the base, intermediate and outer extensions are rectangular. In other specs, they function in a sliding manner with pins 210 and 212 moving in slots or channels 220 and 222 so that outer section 206, intermediate section 204 and intersection 202 move between an extended position for use in a stowed position substantially co-extensive with the diameter of the winch flange.

FIG. 9 also shows an extending grip with an outer section 208 and an extension 214 that may be collapsed to a stowed position within grip 208. Such a grip allows for easier use by a sailor, or allows for two handed use.

In the embodiment depicted in FIGS. 8 and 9 the pins may be fixed to one or the other of the sections whose travels they mediate in order to slide in close cooperation with a slot or channel in the other section. The pins may be fixed to one section or another or may float. The pins may be configured to include a snap fit at one or both of the stowed positions or the extended positions. The operative movement of the pins relative to the slots or channels may be modified with bushings, washers, bearings, or such other known mechanical devices.

Any or all of the components of the present invention, in any of its embodiments, may be made of any suitable material, including without limitation metal, alloys, stainless steel, plastics, carbon fiber materials, graphite or materials that float.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A winch handle for a winch comprising:

an extendable arm, said extendable arm having an extended position and a retracted position, and said extendable arm having a first end attachable to a winch, and;

said retracted position of said extendable arm being no longer than substantially coextensive with a diameter of the winch, and said extended position of said extendable arm being longer than the diameter of the winch;

whereby turning said extendable arm turns the winch; and a cowl, said cowl being attachable to a winch.

2. The winch handle of claim 1 wherein an outer face of said cowl is substantially coextensive with an outer flange of the winch such that coiling and releasing of line onto and off from the winch when said extendable arm is in said retracted position is unimpeded.

3. The winch handle of claim 1 wherein said cowl is adapted to attach to any of a plurality of winches, the winches being different diameters.

4. The winch handle of claim 1 wherein said cowl includes a self-tailing finger.

5. The winch handle of claim 1 further comprising a shroud, said shroud being dimensioned to be operatively interposed between said cowl and the winch and said shroud being substantially coextensive with said outer face of said cowl and said outer flange of the winch such that coiling and releasing of line onto and off from the winch is unimpeded when said extendable arm is in said retracted position.

6. The winch handle of claim 5 wherein said shroud is flexible.

7. A winch handle for a winch comprising:

an extendable arm, said extendable arm having an extended position and a retracted position, and said extendable arm having a first end attachable to a winch, and;

said retracted position of said extendable arm being no longer than substantially coextensive with a diameter of the winch, and said extended position of said extendable arm being longer than the diameter of the winch;

whereby turning said extendable arm turns the winch; and a shroud, said shroud being dimensioned to be operatively interposed between said handle and the winch such that coiling and releasing of line onto and off from the winch is unimpeded when said extendable arm is in said retracted position.

8. The winch handle of claim 7 wherein said shroud is flexible.

9. A winch handle for a winch comprising:

an extendable arm, said extendable arm having an extended position and a retracted position, and said extendable arm having a first end attachable to a winch, and;

said retracted position of said extendable arm being no longer than substantially coextensive with a diameter of the winch, and said extended position of said extendable arm being longer than the diameter of the winch;

whereby turning said extendable arm turns the winch; and a cowl, said cowl being attachable to a winch wherein said extendable arm is biased towards a preconfigured position by a spring in operative engagement with said extendable arm.

* * * * *